US007965494B1

(12) United States Patent
Morris et al.

(10) Patent No.: US 7,965,494 B1
(45) Date of Patent: Jun. 21, 2011

(54) COMBINED BALLAST APPARATUS

(76) Inventors: Michael P. Morris, Arcadia, FL (US); Emily D. Morris, Arcadia, FL (US)

( * ) Notice: Subject to any disclaimer, the term of this patent is extended or adjusted under 35 U.S.C. 154(b) by 126 days.

(21) Appl. No.: 12/562,271

(22) Filed: Sep. 18, 2009

(51) Int. Cl.
*H05B 37/00* (2006.01)

(52) U.S. Cl. ..... 361/674; 361/600; 361/641; 361/836; 362/216; 362/217.05; 362/221; 174/545; 315/209 R; 315/276

(58) Field of Classification Search ..... 361/600, 361/601, 622, 623, 674, 825, 826, 836; 362/216, 362/217.05, 217.08, 221, 217.1, 364, 365, 362/294, 362, 373; 315/32, 224, 225, 219, 315/77, 209 R, 244, 247, 291, 307, 308, 276; 174/50.51, 61, 545, DIG. 2; 336/67, 68; 307/66

See application file for complete search history.

(56) References Cited

U.S. PATENT DOCUMENTS

| | | | | |
|---|---|---|---|---|
| 3,899,632 | A * | 8/1975 | Alley | 361/641 |
| D339,324 | S | 9/1993 | Ahn et al. | |
| 6,339,296 | B1 | 1/2002 | Goral | |
| 6,876,159 | B1 | 4/2005 | Wu et al. | |
| 7,199,529 | B2 | 4/2007 | Vernon-Dier | |
| 2006/0120073 | A1 | 6/2006 | Pickard et al. | |

* cited by examiner

*Primary Examiner* — Michael V Datskovskiy

(74) *Attorney, Agent, or Firm* — Crossley Patent Law; Mark A. Crossley

(57) ABSTRACT

The combined ballast apparatus provides dual function, as both slave ballast and emergency battery ballast, without the expense of a dual installation of ballast onto or into a light fixture. The apparatus is further designed for best efficiency in mounting and in service and removal. The mount holes and quick clips provide for installation to existing fixtures without the need for screwdrivers, for example. The quick connects allow the apparatus to be quickly plugged and unplugged from a light fixture, without having to strip wires and use wire nuts or the like. If equipped with the apparatus and needing a ballast change, the fixture is serviced in a matter of perhaps ¼ to ⅓ the time previously required, without the litter.

5 Claims, 3 Drawing Sheets

COMBINED BALLAST APPARATUS

BACKGROUND OF THE INVENTION

Fluorescent lighting fixtures require ballasts, and, like virtually all such items, ballasts can fail. Historically, two types of ballasts have been used and are typically termed slave ballasts and emergency ballasts. Government standardized codes requite, in public institutions such as offices, schools and the like, that an emergency ballast be installed in addition to the slave ballast that is standard equipment in the fluorescent light fixtures. The emergency ballast is required to operate the light fixture for a specified period of time, typically 90 minutes. The dual installation is less than optimally cost effective. However, current expense considerations can still enjoy a cost benefit with a standard fluorescent fixture installation and emergency ballast installation thereafter. And, if older fixtures are the norm, a fixture replacement with included slave and emergency ballasts may not be preferential to installing an emergency ballast. Additional problems exist in the act of ballast installation and replacement itself, whether emergency or slave. Ballasts currently used typically require about 20 minutes for replacement, as mechanical fasteners are used in their retention, and wires are typically stripped and wire-tied together, with the accompanying mess cleanup requiring additional time. The present apparatus solves these problems.

FIELD OF THE INVENTION

The combined ballast apparatus relates to ballasts used in light fixtures and more especially to a combined slave and emergency ballast that is equipped with quick connections for ballast retention and wiring connection.

SUMMARY OF THE INVENTION

The general purpose of the combined ballast apparatus, described subsequently in greater detail, is to provide a combined ballast apparatus which has many novel features that result in an improved combined ballast apparatus which is not anticipated, rendered obvious, suggested, or even implied by prior art, either alone or in combination thereof.

To attain this, the combined ballast apparatus provides dual function, as both slave ballast and an emergency battery ballast, without the expense of a dual installation of ballast onto or into a light fixture. The apparatus best accommodates such fixtures as the T8, for example. The apparatus is further designed for best efficiency both in mounting and in service and removal. The mount holes and quick clips provide for installation to existing fixtures without the need for screwdrivers, for example. The quick connects allow the apparatus to be quickly plugged and unplugged from a light fixture, without having to strip wires and use wire nuts or the like. If equipped with the apparatus and needing a ballast change, the fixture is serviced in a matter of perhaps ¼ to ⅓ the time previously required.

Thus has been broadly outlined the more important features of the improved combined ballast apparatus so that the detailed description thereof that follows may be better understood and in order that the present contribution to the art may be better appreciated.

An object of the combined ballast apparatus is to save labor costs in ballast installations.

Another object of the combined ballast apparatus is to avoid duplication of labor in ballast installations.

Still another object of the combined ballast apparatus is to provide both a slave ballast and a battery ballast within one case;

Another object of the combined ballast apparatus is to provide for battery replacement;

A further object of the combined ballast apparatus is to retain the installed ballast apparatus without the use of tools.

An added object of the combined ballast apparatus is to remove the ballast apparatus with virtually no tool use.

And, an object of the combined ballast apparatus is to speed wiring connection of the new ballast.

An added object of the combined ballast apparatus is to avoid messes typically accompanying ballast replacement.

These together with additional objects, features and advantages of the improved combined ballast apparatus will be readily apparent to those of ordinary skill in the art upon reading the following detailed description of presently preferred, but nonetheless illustrative, embodiments of the improved combined ballast apparatus when taken in conjunction with the accompanying drawings.

In this respect, before explaining the current embodiments of the improved combined ballast apparatus in detail, it is to be understood that the combined ballast apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved combined ballast apparatus. It is therefore important that the claims be regarded as including such equivalent constructions insofar as they do not depart from the spirit and scope of the combined ballast apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 5 thereof, the principles and concepts of the combined ballast apparatus generally designated by the reference number 10 will be described.

Figure 1:
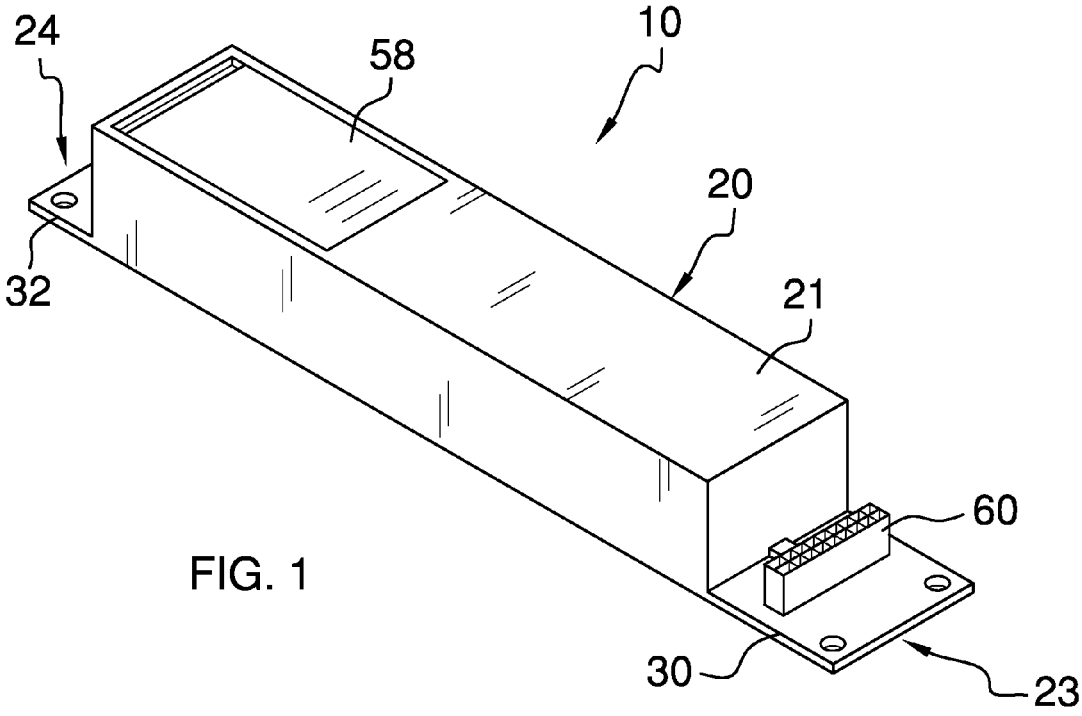
FIG. 1 is a top perspective view.
Figure 2:
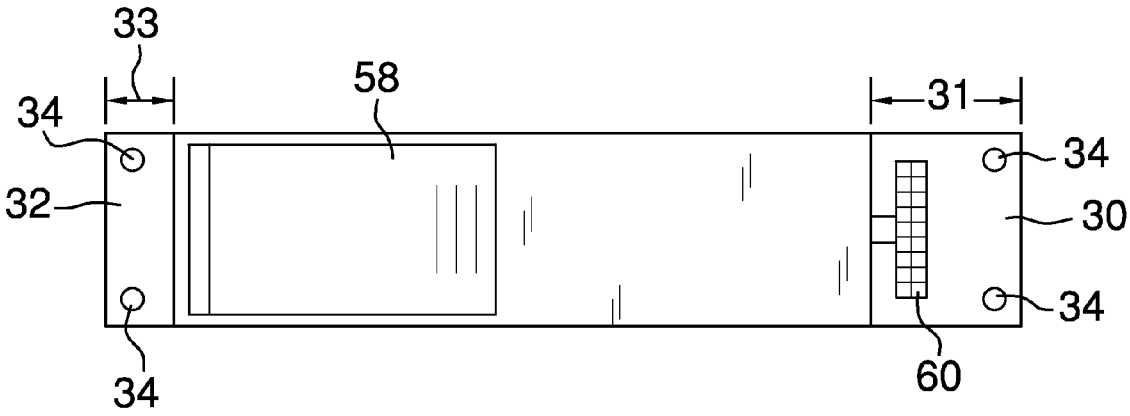
FIG. 2 is a top plan view.

Referring to FIGS. 1 and 2, the apparatus 10 partially comprises the substantially rectangular case 20 having a top 21 spaced apart from the bottom 22 and the first end 23 spaced apart from the second end 24. The first mount ear 30 is extended from the first end 23 bottom 22. The second mount ear 32 is extended from the second end 24 bottom 22. The pair of identical spaced apart mount holes 34 is disposed in the first mount ear 30. A pair of identical spaced apart mount holes 34 is disposed in the second mount ear 32. The female quick connect 60 is disposed on the first mount ear 30. The battery compartment 58 is disposed within the case 20 top 21 proximal to the second end 24.

Figure 3:
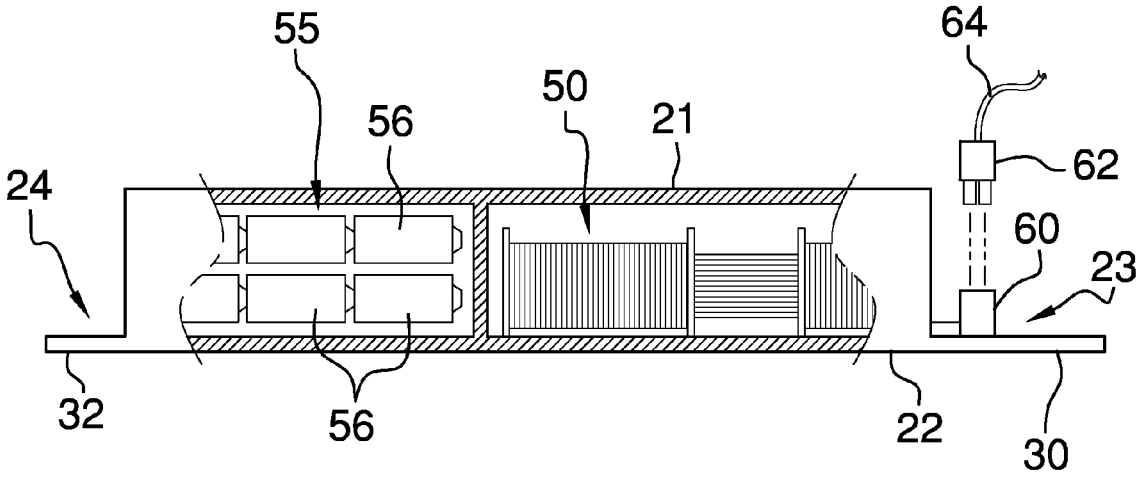
FIG. 3 is a lateral partial cross sectional view.

Referring to FIG. 3, the slave ballast 50 is disposed within the case 20 most proximal to the first end 23. The battery ballast 55 with batteries 56 is disposed within the battery compartment 58. The battery ballast 55 is in communication with the slave ballast 50. Importantly, the batteries 56 within the battery ballast 55 are replaceable. The female quick connect 60 disposed on the first mount ear 30 is in communication with the slave ballast 50.

Figure 4:
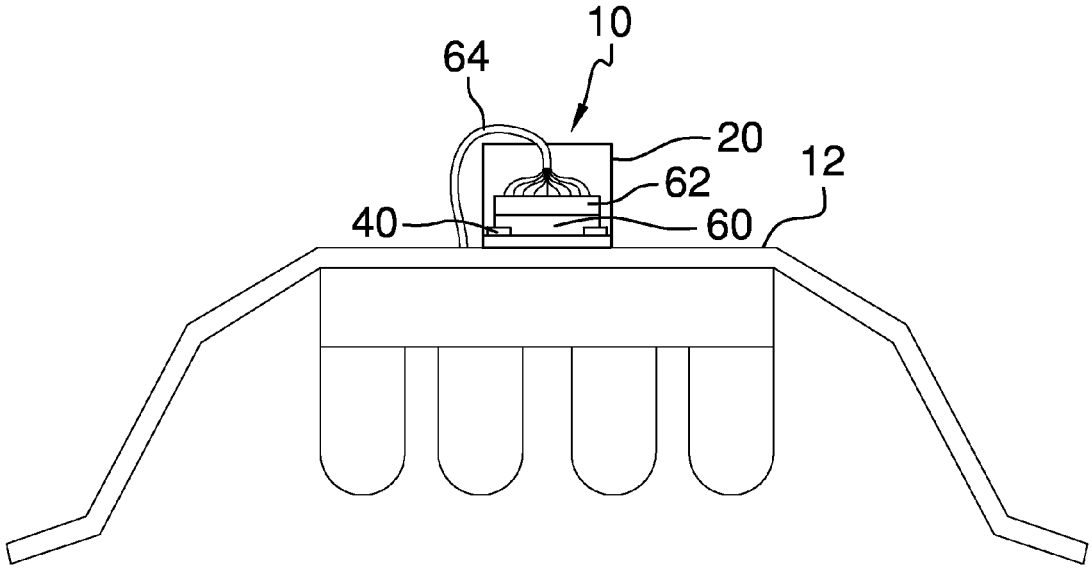
FIG. 4 is an end view on the installed apparatus.
Figure 5:
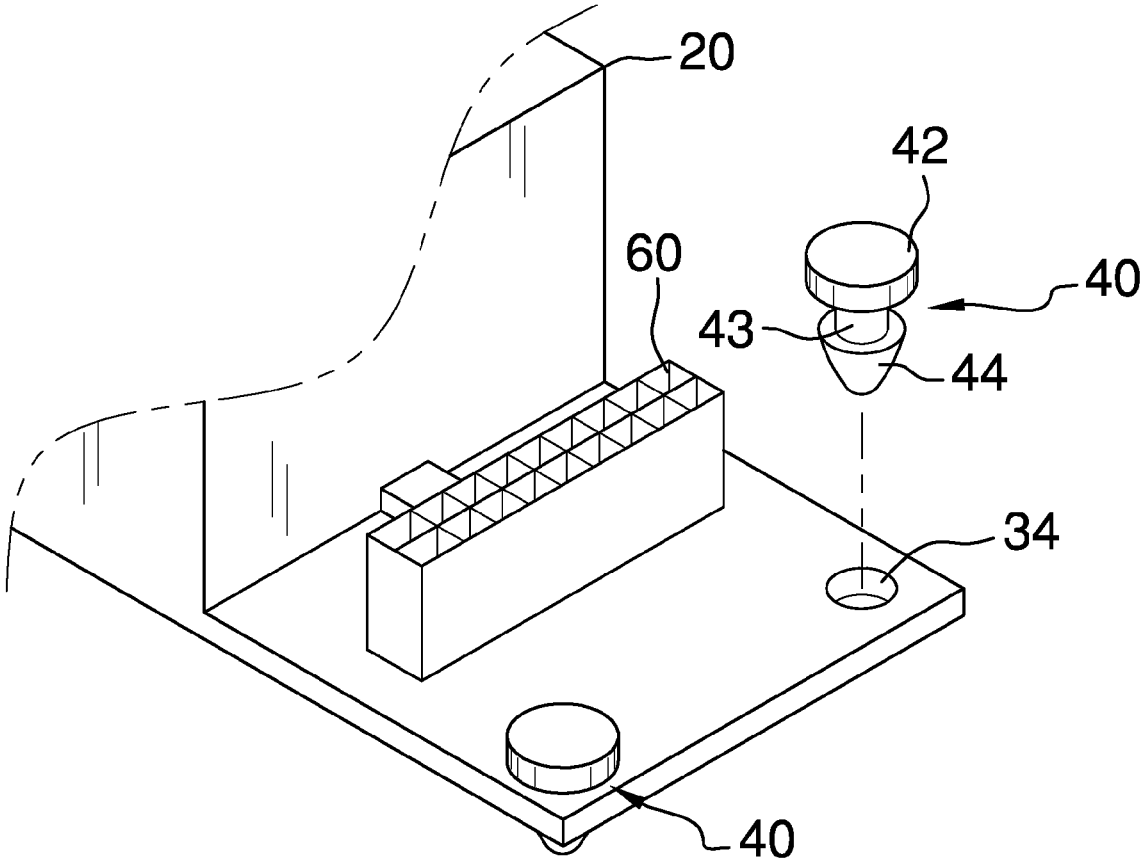
FIG. 5 is a perspective view illustrating the quick clips and the female quick connect.

Continuing to refer to FIG. 3 and referring also to FIG. 4, the male quick connect with wires 62 is removably disposed within the female quick connect 60. The male quick connect 62, once installed in relation to the existing light fixture 12, importantly provides for immediately disconnect and connect to the fixture 12, for future ballast changes, fixture 12 replacement, and other maintenance needs.

Referring to FIG. 5 and again to FIG. 4, the quartet of quick clips 40 is provided with each ballast apparatus 10. The quick clips 40 are removably installed into the mount holes 34 and into an existing fluorescent light fixture 12, thereby providing for rapid removal and addition of the ballast apparatus 10. The quick clips 40 importantly save significant time over typical ballast fasteners that include screws and the like. Importantly, the advantages of the quick clips 40 are enjoyed due to mount ear design and quick clip 40 design. Each quick clip 40 comprises a head 42 affixed to a smaller shank 43. The downwardly ended cone 44 is extended from the shank 43. The cone 44 is larger than the shank 43, thereby retaining the apparatus 10 to the fixture 12 until removed. Each elastomeric quick clip 40 pushes into and is pulled out of the mount holes 34 and the existing fixture 12 as needed.

Referring again to FIGS. 3 and 4, the first ear length 31 is importantly greater than the second ear length 33 so that the female quick connect 60 can be disposed on the first mount ear 30, adjacent to the slave ballast 50 within the case 20. This, in turn, best accommodates the battery compartment 58 being disposed proximal to the second end 24 of the case 20, thereby having battery 56 replacement needs most easily accessed without interference with the wires 64 or quick connects.

With respect to the above description then, it is to be realized that the optimum dimensional relationships for the parts of the combined ballast apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the combined ballast apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the combined ballast apparatus may be used.

Therefore, the foregoing is considered as illustrative only of the principles of the combined ballast apparatus. Further, since numerous modifications and changes will readily occur to those skilled in the art, it is not desired to limit the combined ballast apparatus to the exact construction and operation shown and described, and accordingly, all suitable modifications and equivalents may be resorted to, falling within the scope of the combined ballast apparatus.

What is claimed is:

1. A combined ballast apparatus, comprising, in combination:

a substantially rectangular case having a top spaced apart from a bottom, a first end spaced apart from a second end;

a first mount ear extended from the first end bottom;

a second mount ear extended from the second end bottom;

a pair of identical spaced apart mount holes disposed in the first mount ear;

a pair of identical spaced apart mount holes disposed in the second mount ear;

a slave ballast disposed within the case;

a battery ballast disposed within the case, the battery ballast in communication with the slave ballast;

a female quick connect disposed one of the mount ears, the female quick connect in communication with the slave ballast;

a male quick connect with wires removably disposed within the female quick connect;

a quartet of elastomeric quick clips removably installed into the mount holes and into an existing fluorescent light fixture, each quick clip comprising:

a head;

a shank smaller than the head;

a downwardly ended cone extended from the shank, the cone end larger than the shank.

2. The apparatus according to claim 1 wherein the battery ballast further comprises replaceable batteries.

3. The apparatus according to claim 2 wherein the batteries within the battery compartment are further replaceable from the case top.

4. The apparatus according to claim 3 wherein the battery ballast is further disposed most proximal to the second end.

5. A combined ballast apparatus, comprising, in combination:

a substantially rectangular case having a top spaced apart from a bottom, a first end spaced apart from a second end;

a first mount ear extended from the first end bottom, the first mount ear having a first ear length;

a second mount ear extended from the second end bottom, the second mount ear having a second ear length less than the first ear length;

a pair of identical spaced apart mount holes disposed in the first mount ear;

a pair of identical spaced apart mount hoses disposed in the second mount ear;

a slave ballast disposed within the case most proximal to the first end;

a battery compartment disposed within the case top proximal to the second end;

a battery ballast with replaceable batteries disposed within the battery compartment, the battery ballast in communication with the slave ballast;

a female quick connect disposed on the first mount ear, the female quick connect in communication with the slave ballast;

a male quick connect with wires removably disposed within the female quick connect;

a quartet of elastomeric quick clips removably installed into the mount holes and into an existing fluorescent light fixture, each quick clip comprising:

a head;

a shank smaller than the head;

a downwardly ended cone extended from the shank, the cone end larger than the shank.

* * * * *